US008888516B2

(12) United States Patent
Yu et al.

(10) Patent No.: US 8,888,516 B2
(45) Date of Patent: Nov. 18, 2014

(54) LOW PROFILE ELECTRICAL CONNECTOR WITH REINFORCED PIVOTAL COVER

(75) Inventors: Wang-I Yu, Jhonghe (TW); Chun-Hsien Wu, Jhonghe (TW); Hung-Chi Tai, Jhonghe (TW)

(73) Assignee: Alltop Electronics (Suzhou) Ltd., Taicang, JiangSu Province (CN)

( * ) Notice: Subject to any disclaimer, the term of this patent is extended or adjusted under 35 U.S.C. 154(b) by 250 days.

(21) Appl. No.: 13/608,762

(22) Filed: Sep. 10, 2012

(65) Prior Publication Data

US 2014/0011379 A1 Jan. 9, 2014

(30) Foreign Application Priority Data

Jul. 3, 2012 (CN) ..... 2012 1 0226881

(51) Int. Cl.
*H01R 13/44* (2006.01)

(52) U.S. Cl.
USPC ..... 439/144; 439/152

(58) Field of Classification Search
USPC ..... 439/131, 135, 136, 142, 144
See application file for complete search history.

(56) References Cited

U.S. PATENT DOCUMENTS 5,385,479 A * 1/1995 Okada ..... 439/144
5,411,405 A * 5/1995 McDaniels et al. ..... 439/131
5,538,442 A * 7/1996 Okada ..... 439/676
5,547,401 A * 8/1996 Aldous et al. ..... 439/676
5,562,472 A * 10/1996 Dubois et al. ..... 439/329
5,562,504 A * 10/1996 Moshayedi ..... 439/638
5,634,802 A * 6/1997 Kerklaan ..... 439/131
5,637,018 A * 6/1997 Gargiulo ..... 439/640
5,679,013 A * 10/1997 Matsunaga et al. ..... 439/144
5,727,972 A * 3/1998 Aldous et al. ..... 439/655
5,816,832 A * 10/1998 Aldous et al. ..... 439/131
5,971,777 A * 10/1999 Garside ..... 439/131
5,980,322 A * 11/1999 Madsen et al. ..... 439/620.26
5,989,042 A * 11/1999 Johnson et al. ..... 439/131
6,005,774 A * 12/1999 Chiba et al. ..... 361/737
6,115,256 A * 9/2000 Centofante ..... 361/737
6,129,566 A * 10/2000 Davis et al. ..... 439/131
6,142,834 A * 11/2000 Liao ..... 439/676
6,155,882 A * 12/2000 Wu ..... 439/676
6,159,037 A * 12/2000 Madsen et al. ..... 439/488
6,186,803 B1 * 2/2001 Garside ..... 439/131
6,190,186 B1 * 2/2001 Liao ..... 439/144
6,193,522 B1 * 2/2001 Liao ..... 439/31
6,198,632 B1 * 3/2001 Goff ..... 361/752
6,375,479 B1 * 4/2002 Johnson et al. ..... 439/131
6,386,922 B1 * 5/2002 Forte et al. ..... 439/676
6,398,564 B1 * 6/2002 Wong ..... 439/131
6,398,565 B1 * 6/2002 Johnson et al. ..... 439/131
6,409,549 B1 * 6/2002 Yeh ..... 439/676
6,428,347 B1 * 8/2002 Johnson et al. ..... 439/492

(Continued)

*Primary Examiner* — Ross Gushi
(74) *Attorney, Agent, or Firm* — Sughrue Mion, PLLC

(57) ABSTRACT

An electrical connector includes a base with a number of contacts, a cover pivotally mounted to the base, a pair of supporting components for mating with the cover, and a reinforce piece fixed to the cover. The reinforce piece is fixed to the cover and includes a pair of opposite engaging projections extending into the front opening The cover and the pair of supporting components are mateable with each other in condition that one of the cover and the pair of supporting components pivots clockwise while a remaining one of the cover and the pair of supporting components pivots anti-clockwise. The cover and the supporting components are pivotal between an opening location and a closed location for receiving a plug connector.

20 Claims, 8 Drawing Sheets

(56) References Cited

U.S. PATENT DOCUMENTS

| | | | | |
|---|---|---|---|---|
| 6,482,019 | B1 * | 11/2002 | Lo Forte et al. | 439/131 |
| 6,524,122 | B1 * | 2/2003 | Johnson et al. | 439/131 |
| 6,542,358 | B1 * | 4/2003 | Kunz et al. | 361/679.4 |
| 6,561,824 | B1 * | 5/2003 | Beckham et al. | 439/131 |
| 6,905,351 | B1 * | 6/2005 | Wang et al. | 439/131 |
| 6,932,656 | B2 * | 8/2005 | Kan | 439/681 |
| 6,971,921 | B1 * | 12/2005 | Lai | 439/676 |
| 7,841,876 | B2 * | 11/2010 | Lin et al. | 439/144 |
| 7,950,936 | B2 * | 5/2011 | Wang et al. | 439/144 |
| 8,337,222 | B2 * | 12/2012 | Hung et al. | 439/138 |
| 8,465,304 | B2 * | 6/2013 | Yen | 439/131 |
| 8,758,032 | B2 * | 6/2014 | Liang et al. | 439/131 |
| 2001/0019907 | A1 * | 9/2001 | Glad et al. | 439/131 |
| 2007/0077797 | A1 * | 4/2007 | Reid et al. | 439/131 |
| 2008/0050953 | A1 * | 2/2008 | Reid et al. | 439/131 |
| 2010/0227486 | A1 * | 9/2010 | Lin et al. | 439/144 |
| 2012/0052704 | A1 * | 3/2012 | Yen | 439/131 |
| 2013/0034979 | A1 * | 2/2013 | Chang et al. | 439/131 |
| 2013/0072042 | A1 * | 3/2013 | Liao | 439/142 |
| 2014/0011379 | A1 * | 1/2014 | Yu et al. | 439/136 |
| 2014/0134858 | A1 * | 5/2014 | Tseng et al. | 439/136 |
| 2014/0134859 | A1 * | 5/2014 | Lee et al. | 439/136 |
| 2014/0187064 | A1 * | 7/2014 | Yu et al. | 439/84 |

* cited by examiner

LOW PROFILE ELECTRICAL CONNECTOR WITH REINFORCED PIVOTAL COVER

BACKGROUND OF THE INVENTION

1. Field of the Invention

The present invention relates to an electrical connector, and more particularly, to a low profile RJ 45 connector with a reinforced pivotal cover for receiving a plug connector.

2. Description of Related Art

Notebook computers are usually provided with a number of input/output ports, such as USB ports, RJ 45 ports, VGA ports and some memory card slots, for meeting different applications. With the notebook computers becoming lighter, thinner and smaller, connectors mounted therein should be equivalently thinner and thinner.

A conventional RJ 45 connector is rectangular shaped in integral configuration and usually includes an insulative housing, a number of contacts retained in the insulative housing and a metallic shell enclosing the insulative housing. The insulative housing defines a plug-receiving cavity for receiving a reticle plug. Obviously, since the insulative housing is integrally formed during the manufacturing process, the height thereof is difficult to reduce and control.

Hence, a low profile electrical connector with improved pivotal cover is desired.

BRIEF SUMMARY OF THE INVENTION

The present invention provides an electrical connector including a base, a plurality of contacts retained in the base, a cover pivotally mounted at a rear of the base, a pair of supporting components for mating with the cover, and a reinforce piece fixed to the cover. The base includes a plug-receiving cavity and a slant guiding surface for obliquely guiding insertion of a plug connector into the plug-receiving cavity. Each contact includes a resilient contacting portion protruding into the plug-receiving cavity. The cover is pivotal between an opened status and a closed status with respect to the base along a first pivot member. The cover defines a front opening opposite to the first pivot member. Each supporting component is pivotal between an opened status and a closed status with respect to the base along a second pivot member. The reinforce piece is fixed to the cover and includes a pair of opposite engaging projections both extending into the front opening The cover and the pair of supporting components are mateable with each other in condition that one of the cover and the pair of supporting components pivots clockwise while a remaining one of the cover and the pair of supporting components pivots anticlockwise. The cover and the supporting components are pivotal to an opening location where the plug connector can be inserted into the plug-receiving cavity. The cover and the supporting components are pivotal to a closed location where the plug connector is restricted by the engaging projections so as to be prevented from withdrawing from the plug-receiving cavity.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF THE PREFERRED EMBODIMENTS

Figure 1:
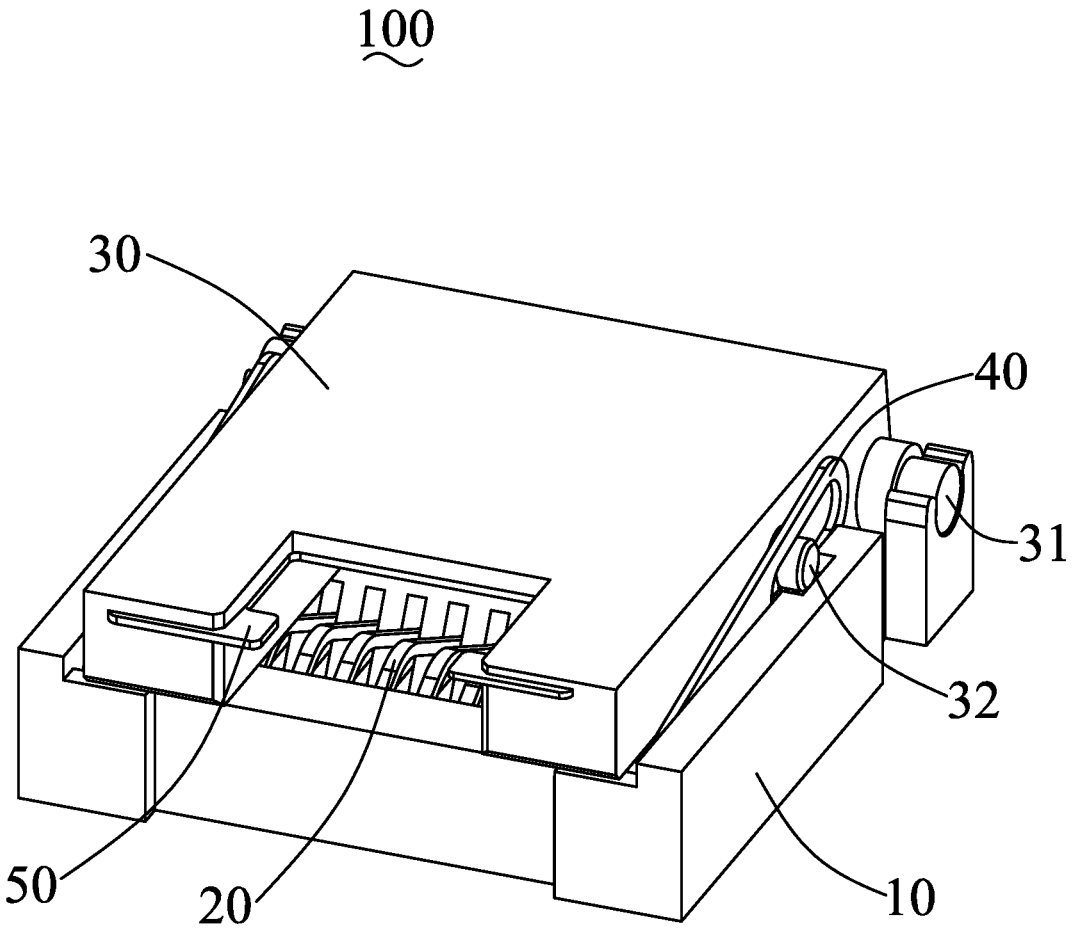
FIG. 1 is a perspective view of an electrical connector with a cover and a pair of supporting components pivotal to a closed location, in accordance with an illustrated embodiment of the present invention.

Reference will now be made to the drawing figures to describe the embodiments of the present invention in detail. In the following description, the same drawing reference numerals are used for the same elements in different drawings.

Figure 2:
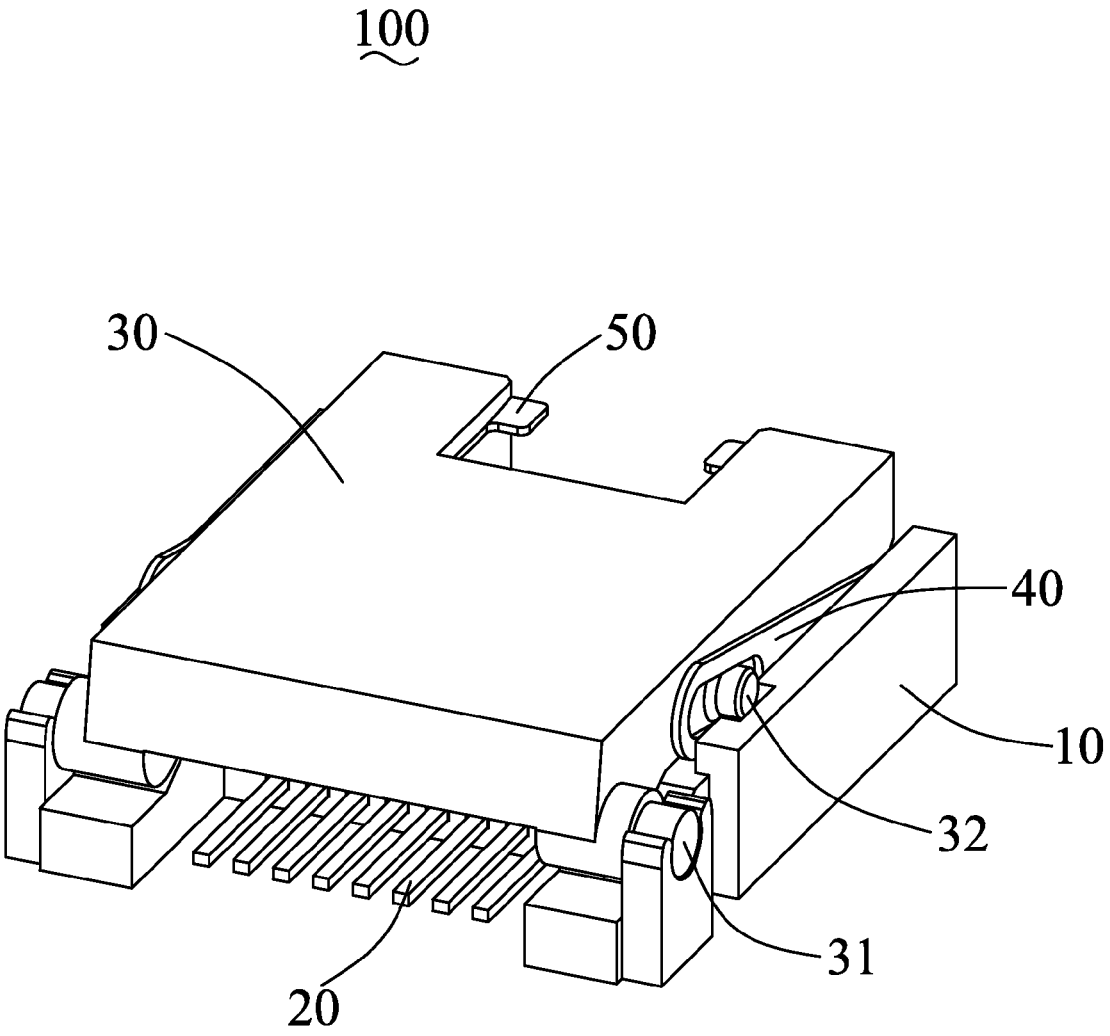
FIG. 2 is a perspective view of the electrical connector as shown in FIG. 1 while taken from a different aspect.

Referring to FIGS. 1 and 2, the present invention discloses an electrical connector 100 mountable on an electronic device, such as a notebook computer, for receiving a plug connector (not shown). The electrical connector 100 includes an insulative base 10, a plurality of contacts 20 retained in the base 10, a cover 30 pivotally mounted at a rear of the base 10 and a pair of supporting components 40 for mating with the cover 30. According to the illustrated embodiment of the present invention, the electrical connector 100 can be a kind of RJ 45 connector.

Figure 3:
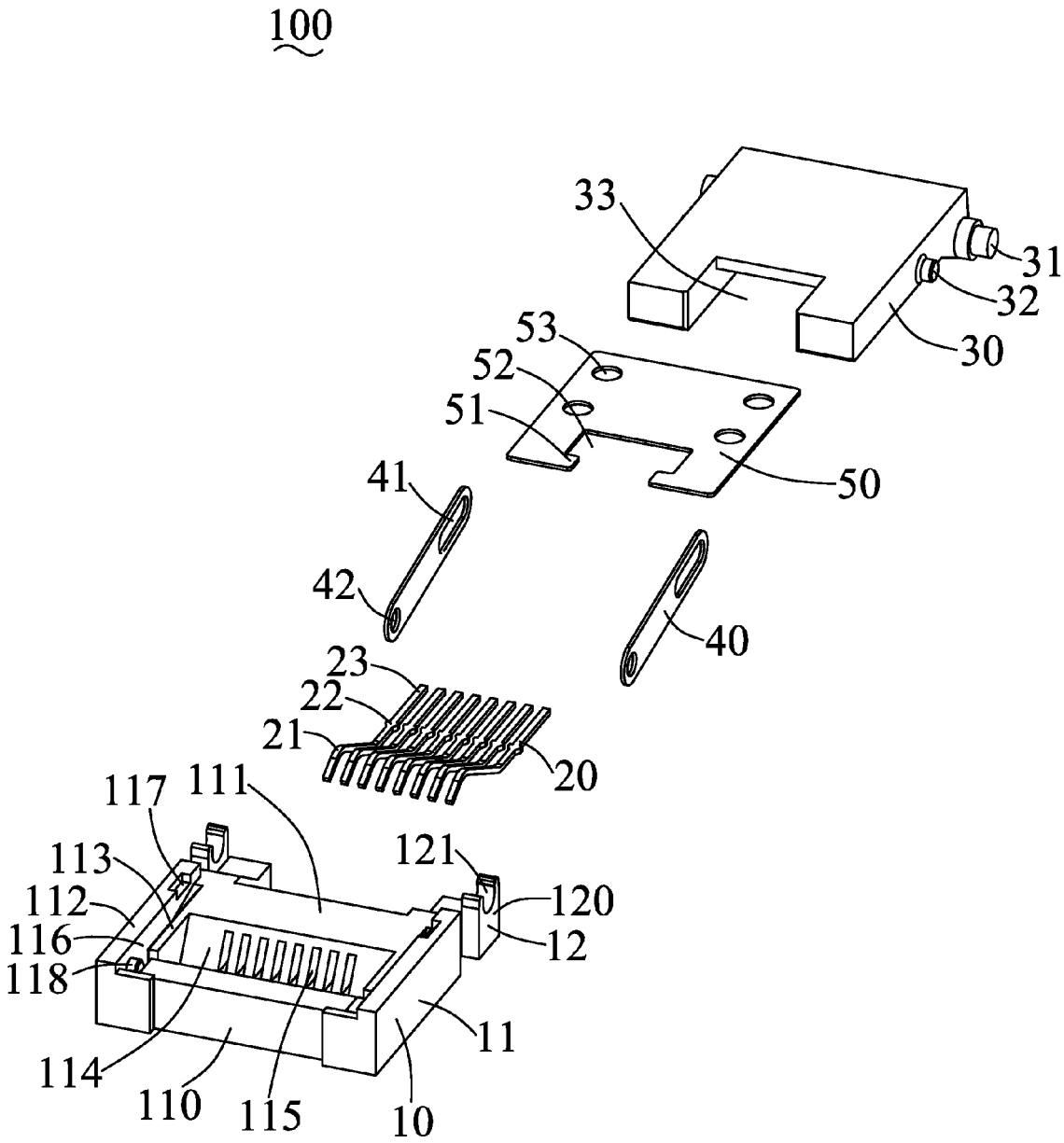
FIG. 3 is an exploded view of the electrical connector as shown in FIG. 1.
Figure 4:
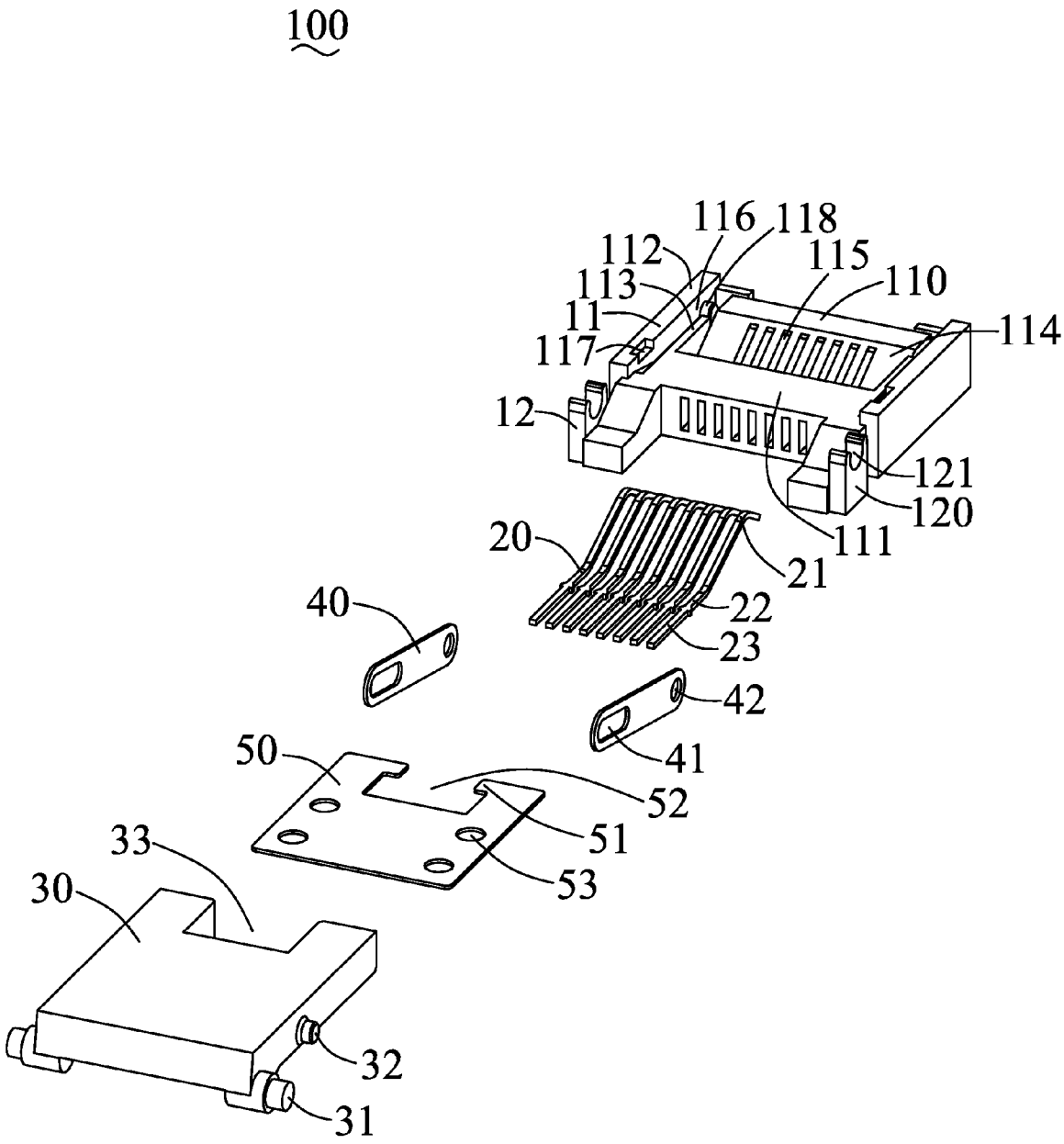
FIG. 4 is an exploded view of the electrical connector as shown in FIG. 2.

Referring to FIGS. 3 and 4, the base 10 includes a main portion 11 and a pair of pivot portions 12 extending backwardly from the main portion 11. The main portion 11 is substantially rectangular shaped and includes a front wall 110, a rear wall 111 and a pair of side walls 112. A plug-receiving cavity 114 is formed between the front wall 110 and the rear wall 111, and between the pair of side walls 112. The front wall 110 comprises a slant guiding surface 113 exposed to the plug-receiving cavity 114 for obliquely guiding insertion of the plug connector into the plug-receiving cavity 114. The rear wall 111 defines a plurality of passageways 115 in communication with the plug-receiving cavity 114 for receiving the contacts 20. Each side wall 112 defines a slit 116, an inclined surface 119 at a bottom of the slit 116 and a rectangular notch 117 outside of the slit 116. Besides, a space 123 is formed between the pair of pivot portions 12. The space 123 is separated from the plug-receiving cavity 114 by the rear wall 111 along a front-to-back direction. Each pivot portion 12 includes a bracket 120 which defines a cutout 121 formed thereon. Each cutout 121 is opened at its top side. According to the illustrated embodiment of the present invention, a cross section of each cutout 121 is semicircular for easily receiving a corresponding portion of the cover 30.

Referring to FIGS. 1 to 4, each contact 20 includes a retaining portion 22 fixed in the passageway 115, a resilient contacting portion 21 protruding forwardly into the plug-receiving cavity 114 for mating with the plug connector, and a tail portion 23 extending backwardly into the space 123 for mounting to a circuit board (not shown).

Referring to FIGS. 3 and 4, according to the illustrated embodiment of the present invention, the cover 30 is substantially rectangular shaped and is made of an insulative material. The cover 30 includes a pair of first shafts 31 formed on lateral sides thereof and a pair of cylinder protrusions 32 at the front of the first shafts 31. Each first shaft 31 is comprised of a larger cylinder 311 and a smaller cylinder 312 which is coaxial with the larger cylinder 311. Each first shaft 31 is positioned at a bottom corner of the cover 30. As clearly shown in FIG. 3, a center line of each first shaft 31 is lower than that of each protrusion 32 for not only reducing a height of the electrical connector 100 but also providing robust engaging force between the base 10 and the cover 30. Besides, the cover 30 defines a rectangular front opening 33 opposite to the first shafts 31.

Referring to FIGS. 1 to 5, in order to enhance rigidity of the cover 30, the electrical connector 100 further includes a metallic reinforce piece 50 fixed to the cover 30. The reinforce piece 50 includes a pair of opposite engaging projections 51 both extending into the front opening 33, a second opening 52 corresponding to the front opening 33 and a plurality of holes 53 into which the insulative material of the cover 30 flows during an injection-molding process. As a result, the reinforce piece 50 is stably embedded in the cover 30.

Figure 5:
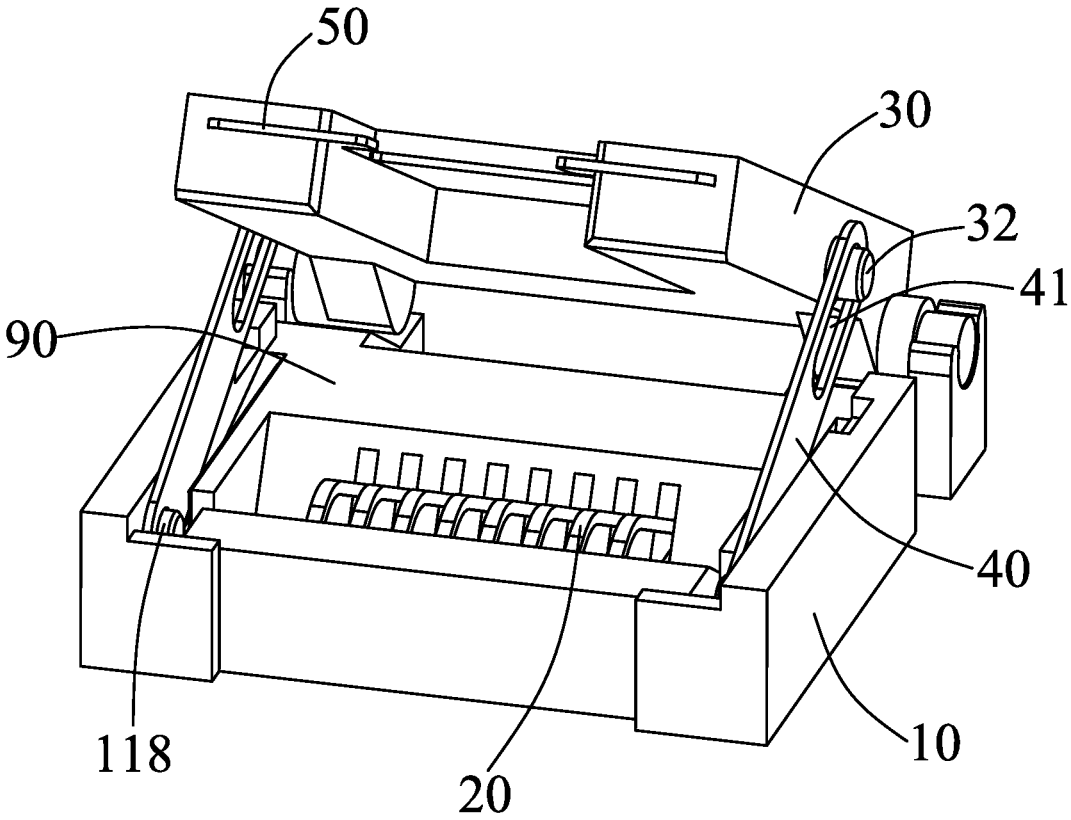
FIG. 5 is a perspective view of the electrical connector with the cover and the pair of supporting components pivotal to an opening location, in accordance with an illustrated embodiment of the present invention.

In other words, the cover 30 is pivotal between an opened status (as shown in FIG. 5) and a closed status (as shown in FIG. 1) with respect to the base 10 along a first pivot member. According to the illustrated embodiment of the present invention, the first pivot member includes the pair of first shafts 31 formed on the lateral sides of the cover 30 and the pair of cutouts 121 formed on the base 10. The pair of first shafts 31 is received in the cutouts 121 along a top-to-bottom direction. Since the cutouts 121 are opened at their top sides, the assembly of the first shafts 31 can be clearly observed and becomes easy. As a result, the first shafts 31 are pivotal in the cutouts 121 so that the cover 30 can be pivotal between the opened status and the closed status. Understandably, the first pivot member is not limited to the illustrated embodiment, for example, the first shafts 31 can be formed on the base 10 while the cutouts 121, or round holes, can be formed on the cover 30.

Referring to FIGS. 1 to 5, the pair of supporting components 40 is stamped from a metal sheet. Each supporting component 40 includes a round hole 42 at a first end and a longitudinal slot 41 at a second end. Accordingly, each side wall 112 of the base 10 includes a second shaft 118 exposed to the slit 116. During assembling, the second shafts 118 are received in the round holes 42, and the protrusions 32 of the cover 30 are slidably received in the longitudinal slots 41. Each supporting component 40 is pivotal between an opened status and a closed status with respect to the base 10 along a second pivot member. According to the illustrated embodiment of the present invention, the second pivot member includes the pair of round holes 42 formed on the pair of supporting components 40 and the pair of second shafts 118 formed in the base 10. The pair of second shafts 118 is pivotal in the round holes 42 so that the supporting components 40 can be pivotal between the opened status and the closed status. Understandably, the second pivot member is not limited to the illustrated embodiment, for example, the second shafts 118 can be formed on the supporting components 40 while the round holes 42 can be formed on the base 10.

Referring to FIGS. 1 and 5, the protrusions 32 are positioned between the first shafts 31 and the second shafts 118 along the front-to-back direction. Each protrusion 32 is slidable in the corresponding longitudinal slot 41, either when the cover 30 pivots from the opened status to the closed status or when the cover 30 pivots from the closed status to the opened status. In detail, one of the cover 30 and the pair of supporting components 40 pivots clockwise while a remaining one of the cover 30 and the pair of supporting components 40 pivots anticlockwise. As shown in FIG. 5, the cover 30 and the supporting components 40 are pivotal to an opening location where the plug connector can be inserted into the plug-receiving cavity 114 through an opening 90. As shown in FIG. 1, the cover 30 and the supporting components 40 are pivotal to a closed location where the plug connector is restricted by the engaging projections 51 so as to be prevented from withdrawing from the plug-receiving cavity 114. At the closed location, the integral configuration of the electrical connector 100 is flat. The cover 30 is essentially parallel to the base 10. It is noticed that, in order to further reduce the height of the electrical connector 100, the base 10 defines an upper depression 13 to partly receive the cover 30 along a vertical direction. A length of the longitudinal slot 41 determines an opening range of the cover 30. Besides, the inclined surfaces 119 support the supporting components 40 when the cover 30 and the supporting components 40 pivotal to the closed location as a result that over-pivoting of the supporting components 40 can be avoided. Besides, as shown in FIGS. 1 and 2, at the closed location, the protrusions 32 are at least received partly in the notches 117.

It is known to those of ordinary skill in the art that it is much easier to match a color of an insulative cover 30 to that of the electronic device in which the electrical connector 100 is mounted. Usually, such color requirement is important for customers' satisfaction. However, if the cover 30 is completely stamped from a metal sheet, since the color of the metal sheet usually does not match that of the electronic device, additional processing, such as coating, about the metal cover should be applied.

Figure 6:
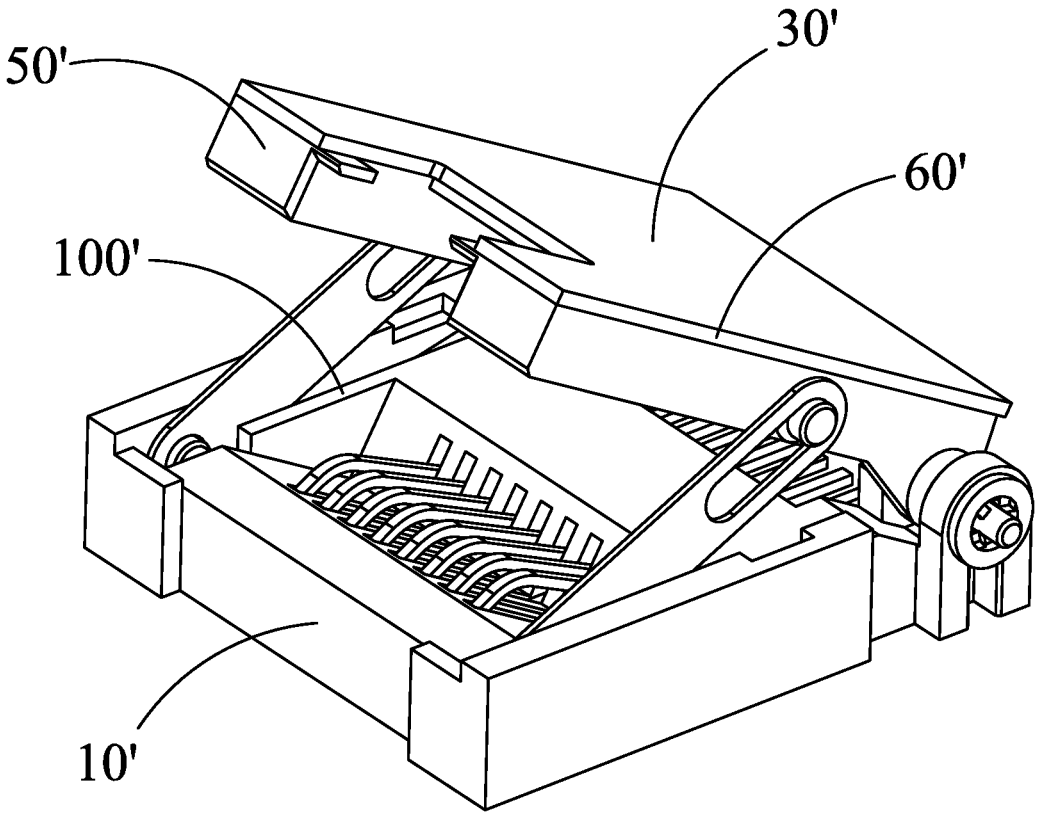
FIG. 6 is a perspective view of the electrical connector with a cover and a pair of supporting components pivotal to an opening location, in accordance with another illustrated embodiment of the present invention.
Figure 7:
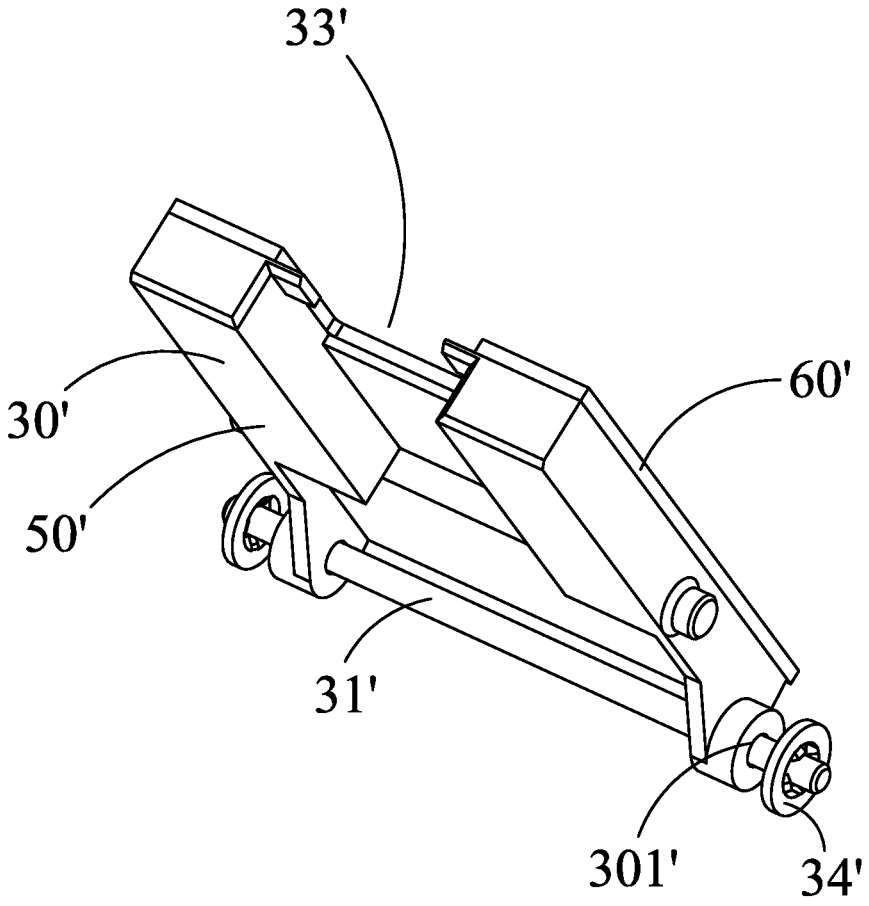
FIG. 7 is a perspective view of a cover member, an axis and a pair of blocking pieces.
Figure 8:
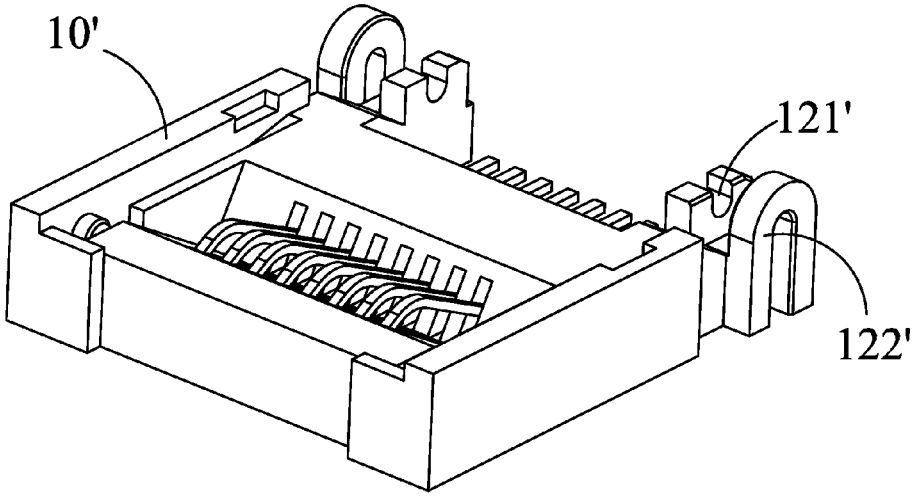
FIG. 8 is a perspective view of a base and a plurality of contacts received in the base.

Referring to FIGS. 6 to 8, an electrical connector 100' according to another embodiment of the present invention is disclosed. The electrical connector 100' includes an insulative base 10, a plurality of contacts 20 retained in the base 10, a cover 30' pivotally mounted at a rear of the base 10 and a pair of supporting components 40 for mating with the cover 30'. The electrical connector 100' is similar to the electrical connector 100 so that the main differences therebetween are described in detail hereinafter.

Referring to FIG. 8, the base 10 includes a main portion 11 defining a plug-receiving cavity 114 and a pair of pivot portions 12' extending backwardly from the main portion 11. Each pivot portion 12' includes an inner wall 121', an outer wall 122', a space 123' between the inner wall 121' and the outer wall 122', and a mounting hole (not labeled) extending through the inner wall 121' and the outer wall 122'. The mounting hole includes a first cutout 124' upwardly opened at a top side of the inner wall 121' and a second cutout 125' downwardly opened at a bottom side of the outer wall 122'.

The cover 30' includes a pair of first shafts 31' formed on lateral sides thereof and a pair of cylinder protrusions 32 at the front of the first shafts 31'. Each first shaft 31' defines a first through hole 311' and is positioned at a bottom corner of the cover 30'. As clearly shown in FIGS. 6 and 7, a center line of each first shaft 31' is lower than that of each protrusion 32 for not only reducing a height of the electrical connector 100' but also providing robust engaging force between the base 10 and the cover 30'. According to another illustrated embodiment of the present invention, the cover 30' is made of a kind of metallic material through press casting for achieve excellent rigidity thereof The cover 30' includes a front opening 301' and a pair of engaging projections 302' extending into the front opening 301' to restrict the plug connector when the plug connector is received in the plug-receiving cavity 114.

The cover 30' is pivotal between an opened status (as shown in FIG. 6) and a closed status (similar to FIG. 1) with respect to the base 10 along a first pivot member. According to the another illustrated embodiment of the present invention, the first pivot member includes the pair of first shafts 31' formed on lateral sides of the cover 30', the pair of mounting holes formed in the base 10 and an axis 35' extending through the first shafts 31' and the mounting holes. The first through holes 311' are in alignment with the mounting holes along a transverse direction perpendicular to the front-to-back direction. The axis 35' is separately made with respect to the cover 30' while inserted through the first through holes 311' and the mounting holes. The electrical connector 100' further includes a pair of blocking pieces 36' outside the outer walls 122'. The pair of blocking pieces 36' is attached to the axis 35' from the opposite ends for fixing the axis 35'.

Referring to FIGS. 6 and 7, in order for color matching, the electrical connector 100' further includes an insulative layer 60' covering the cover 30'. The color of the insulative layer 60' is the same as or similar to that of the electronic device. Besides, the insulative layer 60' defines a second opening 601' corresponding to the front opening 301'.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

We claim:

1. An electrical connector comprising:

a base comprising a plug-receiving cavity and a slant guiding surface for obliquely guiding insertion of a plug connector into the plug-receiving cavity;

a plurality of contacts retained in the base, each contact comprising a resilient contacting portion protruding into the plug-receiving cavity;

a cover pivotally mounted at a rear of the base, the cover being pivotal between an opened status and a closed status with respect to the base along a first pivot member, the cover defining a front opening opposite to the first pivot member;

a pair of supporting components for mating with the cover, each supporting component being pivotal between an opened status and a closed status with respect to the base along a second pivot member; and a reinforce piece fixed to the cover and comprising a pair of opposite engaging projections both extending into the front opening; wherein the cover and the pair of supporting components are mateable with each other in condition that one of the cover and the pair of supporting components pivots clockwise while a remaining one of the cover and the pair of supporting components pivots anticlockwise; and wherein (i) the cover and the supporting components are pivotal to an opening location where the plug connector can be inserted into the plug-receiving cavity; and (ii) the cover and the supporting components are pivotal to a closed location where the plug connector is restricted by the engaging projections so as to be prevented from withdrawing from the plug-receiving cavity.

2. The electrical connector as claimed in claim 1, wherein the cover is insulative, and the reinforce piece is metallic and embedded in the cover for enhancing rigidity of the cover.

3. The electrical connector as claimed in claim 2, wherein the reinforce piece defines a plurality of holes into which a material of the cover flows during an injection-molding process.

4. The electrical connector as claimed in claim 1, wherein the first pivot member comprises a pair of first shafts formed on lateral sides of the cover and a pair of cutouts formed on the base, the pair of first shafts being pivotal in the cutouts so that the cover can be pivotal between the opened status and the closed status.

5. The electrical connector as claimed in claim 4, wherein the base comprises a pair of extensions with the pair of cutouts formed thereon, respectively, each cutout being opened at its top side, each contact comprising a tail portion residing in a space formed between the pair of extensions, the space being separated from the plug-receiving cavity along a front-to-back direction.

6. The electrical connector as claimed in claim 4, wherein the second pivotal member comprises a pair of round holes formed on the pair of supporting components, respectively, and a pair of second shafts formed in the base, the pair of second shafts being pivotal in the round holes so that the supporting components can be pivotal between the opened status and the closed status.

7. The electrical connector as claimed in claim 6, wherein the base defines a pair of side walls at opposite sides of the plug-receiving cavity, each side wall defining a slit for receiving corresponding supporting component, the second shafts being exposed to the slits.

8. The electrical connector as claimed in claim 7, wherein each supporting component defines a longitudinal slot opposite to corresponding round hole, the cover comprising a pair of protrusions on the lateral sides thereof, the protrusions being positioned between the first shafts and the second shafts along a front-to-back direction, each protrusion being slidable in corresponding longitudinal slot either when the cover pivots from the opened status to the closed status or when the cover pivots from the closed status to the opened status.

9. The electrical connector as claimed in claim 8, wherein a center line of each first shaft is lower than that of each protrusion for not only reducing a height of the electrical connector but also providing robust engaging force between the base and the cover.

10. An electrical connector for being mounted in an electronic device, comprising:

a base defining a plug-receiving cavity;

a plurality of contacts with resilient contacting portions protruding into the plug-receiving cavity for mating with a plug connector;

a cover pivotally mounted at a rear of the base, the cover being pivotal with respect to the base along a first pivot member; and a pair of supporting components for mating with the cover, each supporting component being pivotal with respect to the base along a second pivot member; wherein each supporting component comprises a slot and the cover comprises a pair of protrusions slidable in the slots for controlling an opening range of the cover; and wherein the cover and the pair of supporting components are mateable with each other in condition that one of the cover and the pair of supporting components pivots clockwise while a remaining one of the cover and the pair of supporting components pivots anticlockwise; and wherein the cover and the supporting components are pivotal to an opening location where the plug connector can be inserted into the plug-receiving cavity, and the cover and the supporting components can be pivotal to a closed location where the plug connector is maintained in the plug-receiving cavity; and wherein the protrusions are located between the first pivotal member and the second pivot member along a front-to-back direction while a center line of the first pivot member is lower than that of the protrusions.

11. The electrical connector as claimed in claim 10, wherein the cover is made of a kind of metallic material through press casting, the cover comprising a front opening opposite to the first pivot member and a pair of engaging projections extending into the front opening to restrict the plug connector when the plug connector is received in the plug-receiving cavity.

12. The electrical connector as claimed in claim 10, further comprising an insulative layer covering the cover, a color of the insulative layer being the same as or similar to that of the electronic device.

13. The electrical connector as claimed in claim 10, wherein the first pivot member comprises a pair of first shafts formed on lateral sides of the cover, a pair of mounting holes formed in the base and an axis extending through the first shafts and the mounting holes.

14. The electrical connector as claimed in claim 13, wherein each first shaft defines a first through hole in alignment with the mounting holes along a transverse direction, the axis being separated made with respect to the cover while is inserted through the first through holes and the mounting holes.

15. The electrical connector as claimed in claim 14, wherein the base comprises a pair of backward extensions each of which comprises an inner wall, an outer wall and a space between the inner wall and the outer wall to receive the first shafts.

16. The electrical connector as claimed in claim 15, wherein each mounting hole comprises a first cutout upwardly opened at a top side of the inner wall and a second cutout downwardly opened at a bottom side of the outer wall.

17. The electrical connector as claimed in claim 16, further comprising a pair of blocking pieces outside of the outer walls, the pair of blocking pieces being attached to the axis from opposite ends for fixing the axis.

18. The electrical connector as claimed in claim 10, wherein the second pivotal member comprises a pair of round holes formed on the pair of supporting components, respectively, and a pair of second shafts formed in the base, the pair of second shafts being pivotal in the round holes.

19. The electrical connector as claimed in claim 18, wherein the base defines a pair of side walls at opposite sides of the plug-receiving cavity, each side wall defining a slit for receiving corresponding supporting component, the pair of second shafts being exposed to the slits.

20. The electrical connector as claimed in claim 19, wherein each side wall comprises an inclined surface at a bottom of the slit, the inclined surface supporting the supporting component when the cover and the supporting components pivotal to the closed location for avoiding over-pivot of the supporting components.

* * * * *